US006322333B1

(12) United States Patent
Knight

(10) Patent No.: US 6,322,333 B1
(45) Date of Patent: Nov. 27, 2001

(54) DEVICE FOR ENHANCING FLUID FLOW

(76) Inventor: Roy Knight, P.O. Box 1516, Norman, OK (US) 73070

( * ) Notice: Subject to any disclaimer, the term of this patent is extended or adjusted under 35 U.S.C. 154(b) by 0 days.

(21) Appl. No.: 09/472,689

(22) Filed: Dec. 27, 1999

Related U.S. Application Data

(63) Continuation-in-part of application No. 08/986,129, filed on Dec. 5, 1997, now abandoned.

(51) Int. Cl.[7] ..... F04B 35/02
(52) U.S. Cl. ..... 417/390; 417/405
(58) Field of Search ..... 417/405, 390, 417/379, 313; 166/357

(56) References Cited

U.S. PATENT DOCUMENTS

| | | | | |
|---|---|---|---|---|
| 533,226 | | 1/1895 | Merrill . | |
| 850,037 | | 4/1907 | Moser . | |
| 865,296 | | 9/1907 | Conrader . | |
| 1,198,247 | | 9/1916 | McCombs | 417/121 X |
| 1,206,065 | | 11/1916 | Watts et al. . | |
| 1,294,069 | | 2/1919 | English . | |
| 1,403,699 | * | 1/1922 | Loewenthal | 175/101 |
| 1,775,759 | * | 9/1930 | Grant | 417/405 |
| 1,833,214 | | 11/1931 | Gray et al. . | |
| 2,726,606 | * | 12/1955 | Davidson | 103/87 |
| 3,773,437 | | 11/1973 | Suman, Jr. . | |
| 3,788,771 | | 1/1974 | Akins, Sr. . | |
| 4,330,306 | | 5/1982 | Salont . | |
| 4,802,829 | | 2/1989 | Miller . | |
| 4,913,630 | * | 4/1990 | Cotherman | 417/313 |
| 5,044,440 | * | 9/1991 | Stinessen | 166/344 |
| 5,252,025 | | 10/1993 | Kida et al. . | |
| 5,698,014 | * | 12/1997 | Cadle | 96/157 |
| 5,860,795 | * | 1/1999 | Ridley | 417/403 |

* cited by examiner

*Primary Examiner*—Timothy S. Thorpe
*Assistant Examiner*—Ehud Gartenberg
(74) *Attorney, Agent, or Firm*—R. William Graham

(57) ABSTRACT

A device for enhancing fluid flow in a well, which includes a housing, a first chamber, and a shaft bored surface interconnecting the first and a second chamber, a rotor rotatably mounted within the first chamber and connected to the shaft, a pump impeller rotor rotatably mounted within the second chamber and connected to the shaft in a manner to aid fluid flow.

5 Claims, 6 Drawing Sheets

DEVICE FOR ENHANCING FLUID FLOW

This is a continuation-in-part of Ser. No. 08/986,129 filed Dec. 5, 1997 abandoned.

BACKGROUND OF THE INVENTION

1. Field of the Invention

The present invention relates generally to a fluid flow enhancing device. More particularly, but not by way of limitation, the invention relates to a fluid lifting device for use in lifting fluids from wells.

2. Related Art

There exist a large number and variety of fluid lifting devices for aiding fluid flow. Common to many of these devices are a pipe with some internal means for driving fluid in a desired direction. The driving means have included pumps, motor driven bowl and impeller devices and air.

While these prior devices attempted to improve fluid flow, for example in a well, there remains a need to provide a more efficient device for enhancing fluid flow. Accordingly, the present invention improves upon the art of enhancing fluid flow within a pipe and particularly lifting fluids from a well.

BRIEF SUMMARY OF THE INVENTION

It is an object to enhance fluid flow through conduits.

It is another object to enhance fluid flow and lifting fluid from wells.

It is another object to provide a device in a well for enhancing fluid flow therefrom and harness energy from the fluid flow to further enhance the fluid flow.

It is another object to utilize the fluid flow pressure from a well for lifting the fluid in an improved economical manner without the need for the present energy required by conventional reciprocating or turbine pumps.

Accordingly, the present invention is directed to a device for enhancing fluid flow in a well, which includes a housing, a first inlet in the housing to receive a propellant, a first chamber within the housing communicating with the first inlet, a first one way check valve disposed in the housing in a manner to permit communication from the first inlet to the first chamber, means for biasing the first one way check valve closed until reaching a first predetermined pressure of the propellant, a second chamber in the housing generally axially aligned with the first chamber, and a shaft bored surface interconnecting the first and the second chamber.

Further, a shaft is rotatably disposed within the shaft bored surface and extending from the first chamber to the second chamber, means for sealing about the shaft to prevent communication between the first chamber and the second chamber, a rotor rotatably mounted within the first chamber and fixably connected to the shaft, a first exit channel within the housing connected to the first chamber, an outlet in the housing communicating with the first exit channel, a second one way check valve disposed in the housing in a manner to permit communication from the first exit channel to the outlet, a second inlet in the housing communicating with the second chamber to permit receipt oil fluids from the well therein, and a second exit channel within the housing interconnecting the second chamber with the outlet.

Also, a pump impeller rotor rotatably mounted within the second chamber and fixably connected to the shaft in a manner to aid fluid flow from the second inlet to the second exit channel, a third one way check valve disposed in the housing, in a manner to permit communication from the second exit channel through to the outlet, and means for biasing the first one way check valve closed until reaching a first predetermined pressure of the fluid from the well.

In a preferred embodiment the propellant is air. The device further includes a fluid/air separator operably disposed downstream from the outlet in a manner to receive the fluid/air and separate the air and fluid.

Other objects and advantages will be readily apparent to those skilled in the art upon viewing the drawings and reading the detailed description hereafter.

DETAILED DESCRIPTION OF THE INVENTION

Figure 1:
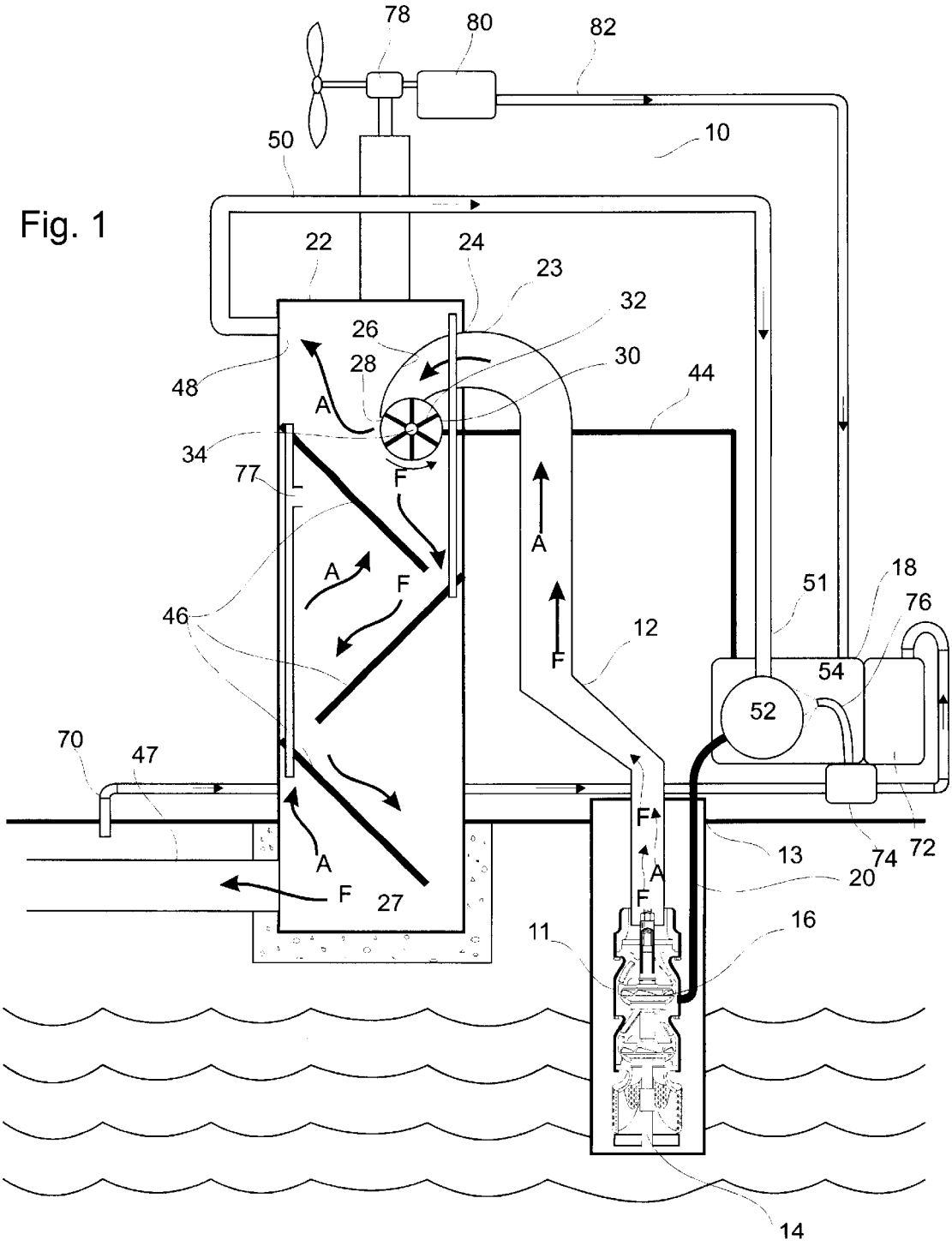
FIG. 1 is a schematic view of the present invention.

Referring to the drawings, the fluid flow enhancing device of the present invention is generally referred to by the numeral 10. The device 10 includes a pipe 12 partially disposed in a well bore casing 13, a pump housing 11 having a shaft 14 rotatably axially disposed therein and the housing 11 being within the pipe 12, a series of impellers 16 concentrically fixedly mounted about the shaft 14 in a manner to permit rotation thereof along with the shaft 14 without contacting the pipe 12 and which permits fluid flow thereby. An air compressor 18 is provided having a conduit 20 with an end operably positioned adjacent one of the impellers 16*a* in a manner to permit direction of at least one of an air and fluid stream onto the impeller 16*a* to further rotation thereof and in turn further a fluid flow stream of fluid (F)/air (A) through the pipe 12. The fluid flow device 10 further includes a fluid/air separator 22 operably disposed downstream from the impellers 16 and is connected to the pipe 12 in a manner to receive the fluid/air.

Figure 3:
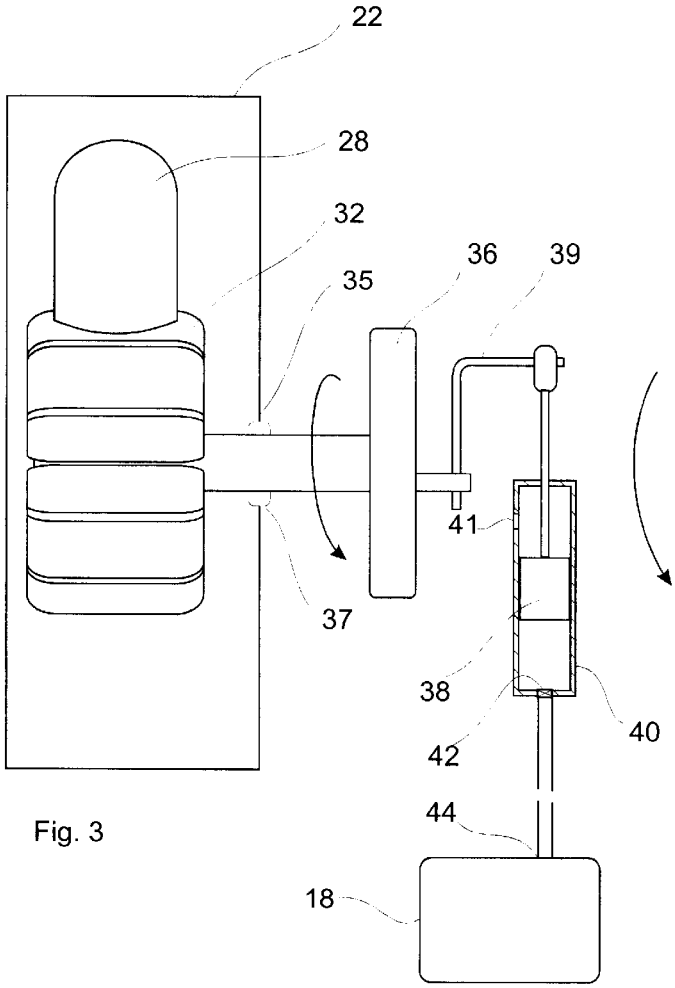
FIG. 3 is an enlarged cross-sectional view of an other part of the present invention.
Figure 4:
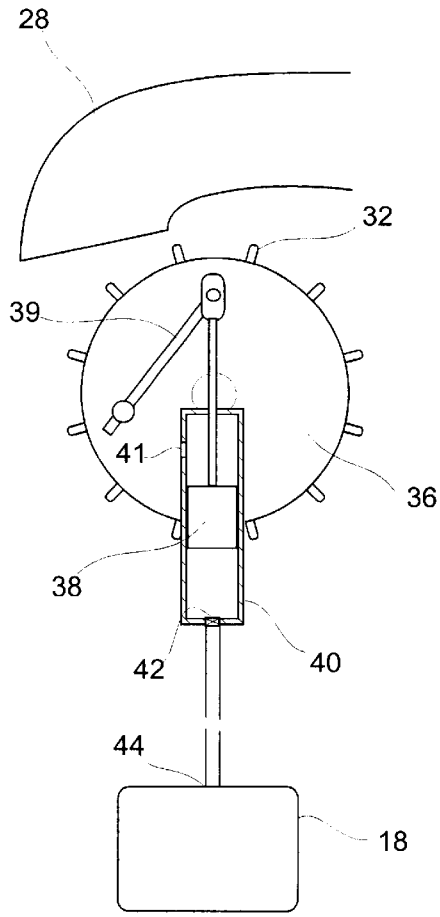
FIG. 4 is an end view of FIG. 3.

More particularly and referring to FIG. 3, the pipe 12 has an end 23 which is communicably connected to a top open portion 24 of the separator 22 and extends partially therein terminating in an upper inside portion 26 of the separator 22. Operably positioned below a terminal portion 28 of the end 23 is a gravitational fluid driven wheel 30 having a plurality of paddles 32 rigidly connected to unidirectional rotatable shaft 34. The wheel 30 is disposed adjacent the terminal portion 28 of the pipe 12 and the shaft 34 partially extends within the separator 22 at an open surface 35 and includes a seal 37 therebetween.

The rotatable shaft 34 is operably fixedly connected to a crank 36 having a movably connected arm 39 which is movably connected to a piston 38. The piston 38 is sealingly reciprocally movably disposed within a cylinder 40. A one way check valve 42 is disposed in the cylinder 40 through which air is passed to a conduit 44 and in turn passed to the compressor 18.

As seen in FIG. 1, the fluid/air enters the upper inside portion 26 of the separator 22 the fluid moves downward through a series of baffles 46 to a bottom inside portion 27. The fluid passes to a communicably connected recovery conduit 47 at the bottom of the separator 22 for use as desired. The recovered air is permitted to flow upward through vent pipe 77 and is vented out another open surface 48 of the separator 22 which is communicably connected to a conduit 50. The conduit 50 is operably connected to the compressor 18 wherein the recovered air is used for cooling the compressor 18.

The compressor 18 can be of any suitable type known to one skilled in the art which is equipped with suitable means 52 for producing compressed air and has a reservoir 54 for storing compressed air. The conduit 44 is communicably connected to the reservoir 54 and the conduit 50 has an end 51 which is operably positioned adjacent the producing means 52 to direct the air thereon.

Figure 2:
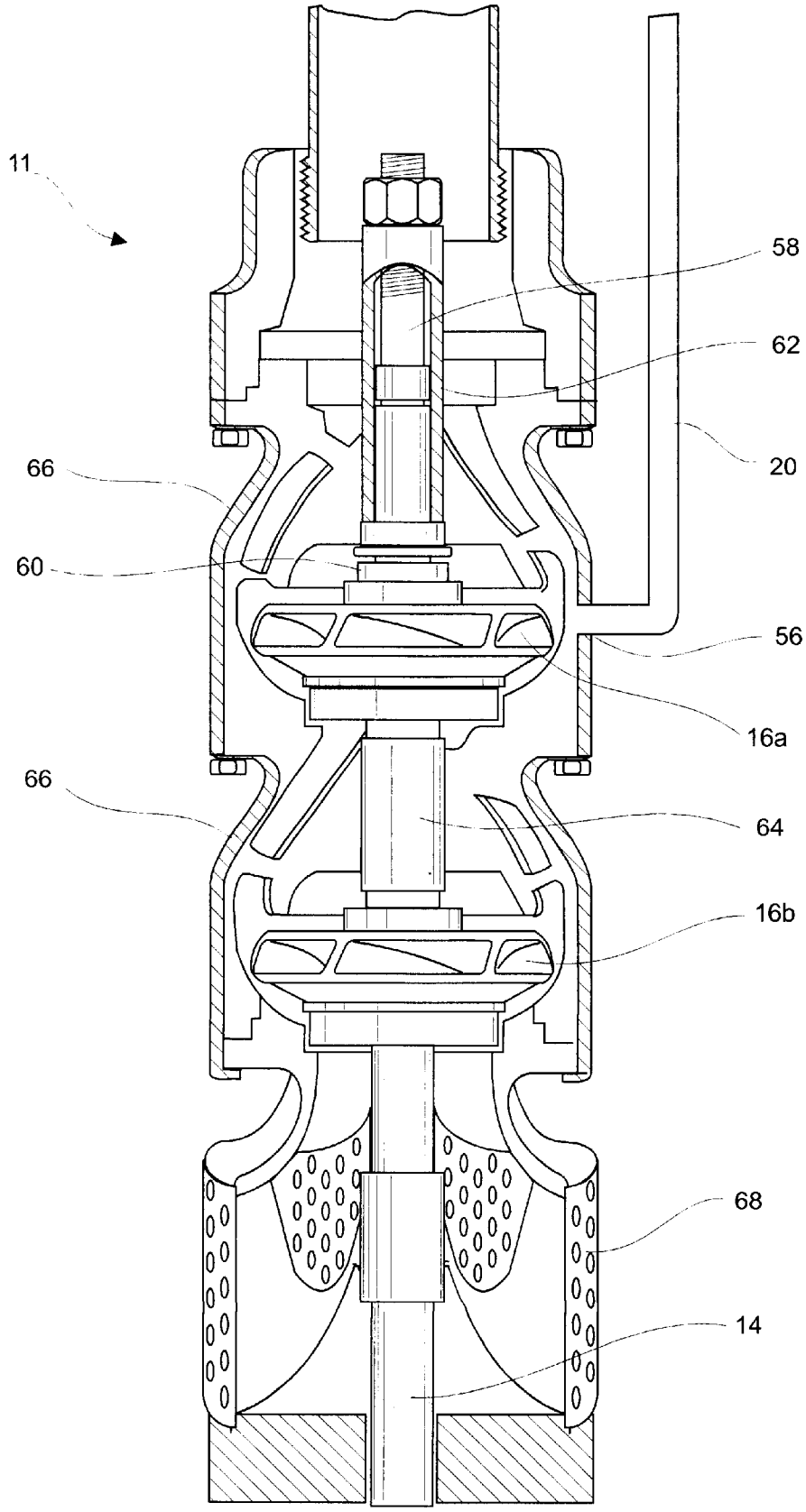
FIG. 2 is a cross-sectional view of a part of the present invention.

Viewing FIG. 2, an enlarged view of a portion of FIG. 1 is shown which depicts the impellers 16 and shaft 14 disposed within the housing 11. The compressed air conduit 20 is shown as communicably connecting to an open surface portion 55 of the pipe 12. The shaft 14 is a bowlshaft-type and has a thrust screw portion 58, impeller lock collets 60 and sleeve bearings 62 and 64 all of which cooperate to maintain the impellers 16 in an axially fixed but rotatable position. The pipe 12 has bowl portions 66 as is known in the art to pen-nit fluid flow thereby. A strainer screen 68 is operably connected to an end of the pipe 12 o permit fluid flow into the pipe.

A conduit 70 is communicably connected at one end to the conduit 47 for receiving a portion of water therefrom. Another end of the conduit 70 is communicably connected to a water tank 72 which is disposed adjacent the compressor 54. A pump 74 is operably communicably connected to the water tank 72 to draw water therefrom. A conduit 76 is communicably connected to the pump 74 and is equipped with a terminal end having a nozzle to effect a spray mist of the water. The terminal end is directed at the compressor 52 to aid in cooling the same.

Preferably disposed on the separator 22 is a wind driven crank 78 which is operably linked to a compressor 80 of a like design to that previously described. A conduit 82 communicably interconnects the compressor 80 and the tank 54. Here, the compressed air is generated from forces of the wind and decrease the amount of fuel required to run the compressor 52. In this regard, the compressor 52 includes a pressure transducer which initiates the compressor 52 when the pressure drops below a predetermined amount.

Alternative embodiments depicted in FIGS. 2*a*–2*c*, and 2*d* show an improved device 11' for enhancing fluid flow in a well. The device 11' includes a housing 12', a first inlet 14' in the housing 12' to receive the propellant air A.

A first chamber 16' within the housing 12' communicates with the first inlet 14'. A first one way ball-type check valve 18' is disposed in the housing 12' in a manner to permit communication from the first inlet 14' to the first chamber 16'. A spring 20' biases the first one way check valve 18' closed until reaching a first predetermined pressure of the propellant.

A second chamber 22' is in the housing 12' and is generally axially aligned with the first chamber 16'. A shaft bored surface 24' interconnects the first chamber 16' and the second chamber 22'. A shaft 26' is rotatably disposed within the shaft bored surface 24' and extends from the first chamber 16' to the second chamber 22'.

Sealing means 28' and 29' are provided for sealing about the shaft 26' to prevent communication between the first chamber 16' and the second chamber 22'. Bearing 30', which can be of the packed ball-type, is disposed between the sealing means 28' and 29' to provide a movable bearing surface. Further sealing means 32' and bearing 34' are provided above the first chamber 16' and likewise functionally connect to the shaft 26'.

A rotor 36' shown is of the air-driven type with a plurality of radially movable blades 38' which slide in and out of slotted surfaces 40' of the rotor 36'. The rotor 36' is rotatably mounted within the first chamber 16' and can be connected to the shaft 26' by way of keyed and /or hexed surfaces known to the art to prevent rotational slippage with respect to said shaft (or can be threaded screw).

A first exit channel 42' is the housing 12' connected to the first chamber 16'. An outlet 44' in the housing 12' communicates with the first exit channel 42'. A second one way ball-type check valve 46' is disposed in the housing 12' in a manner to permit communication from the first exit channel 42' to the outlet 44'. A second inlet 48' in the housing 12' communicates with the second chamber 22' to permit receipt of fluids from the well therein. A screen 50' is provided to aid in substantially only permitting fluids therethrough. A second exit channel 52' is in the housing 12' which interconnects the second chamber 22' with the outlet 44'.

A pump impeller rotor 54' is rotatably disposed within the second chamber and slidably connected to the shaft 26' in a keyed and/or hexed manner to prevent rotational slippage with respect to the shaft 26' and to aid fluid flow from the second inlet 48' to the second exit channel 52'. A third one way ball-type check valve 56' disposed in the housing 12' in a manner to permit communication from the second exit channel 52' through to the outlet 44'. A spring 58' biases the third one way check valve closed until reaching a first predetermined pressure of the fluid from the well.

Figures 2A, 2D:
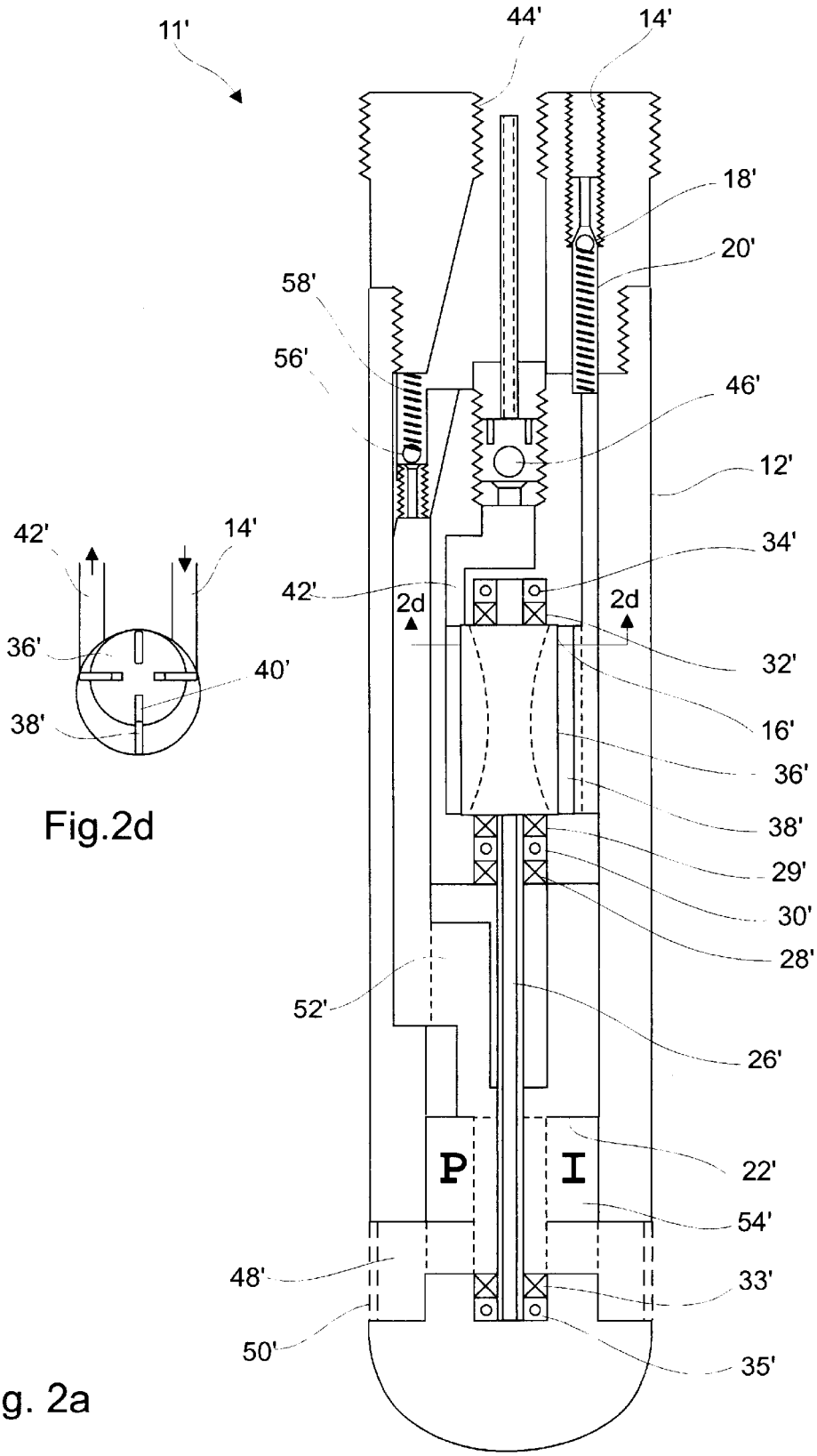
FIG. 2*a* is a cross-sectional view of an alternative part of the present invention.
FIG. 2*d* is a cross-sectional view of a part of the present invention through line 2*d*—2*d*.
Figure 2B:
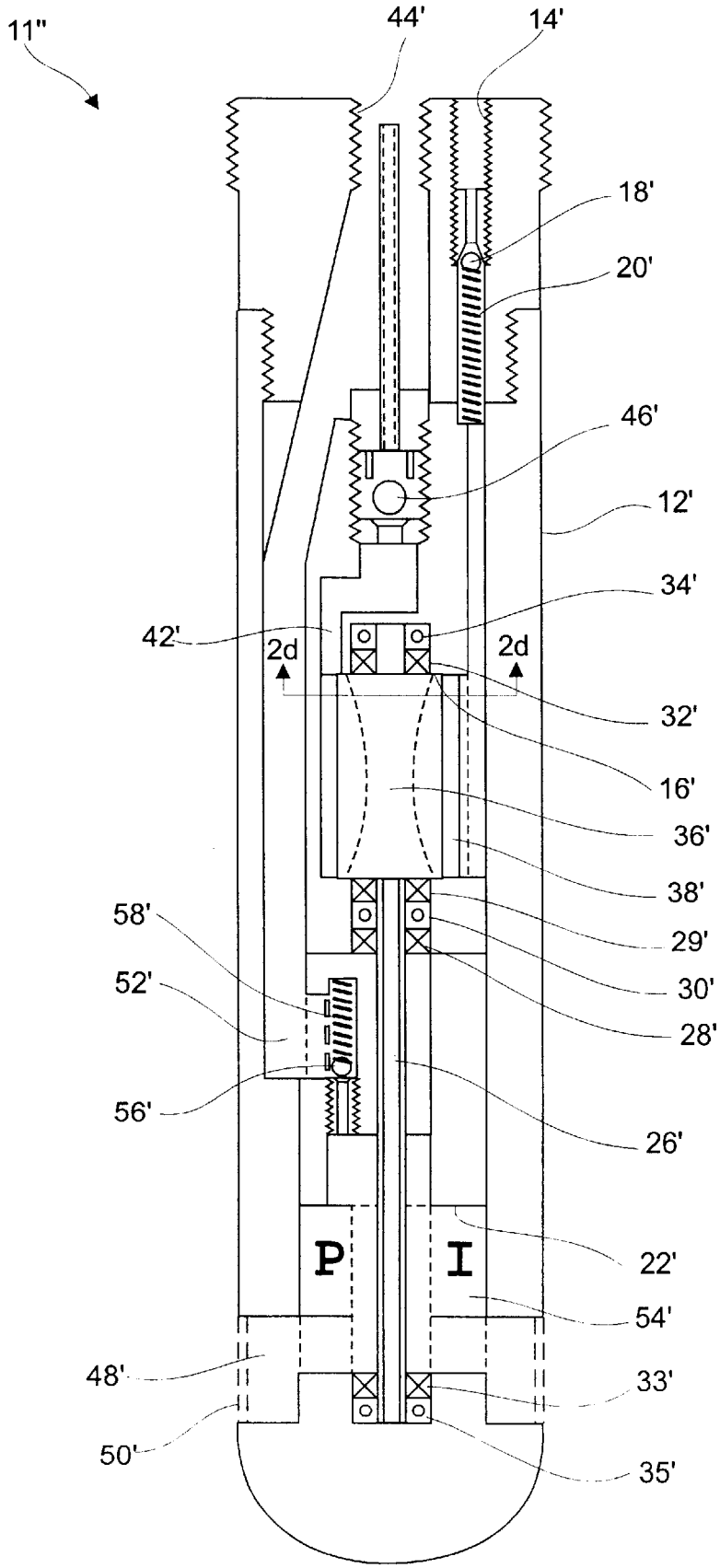
FIG. 2*b* is a cross-sectional view of an alternative part of the present invention.
Figure 2C:
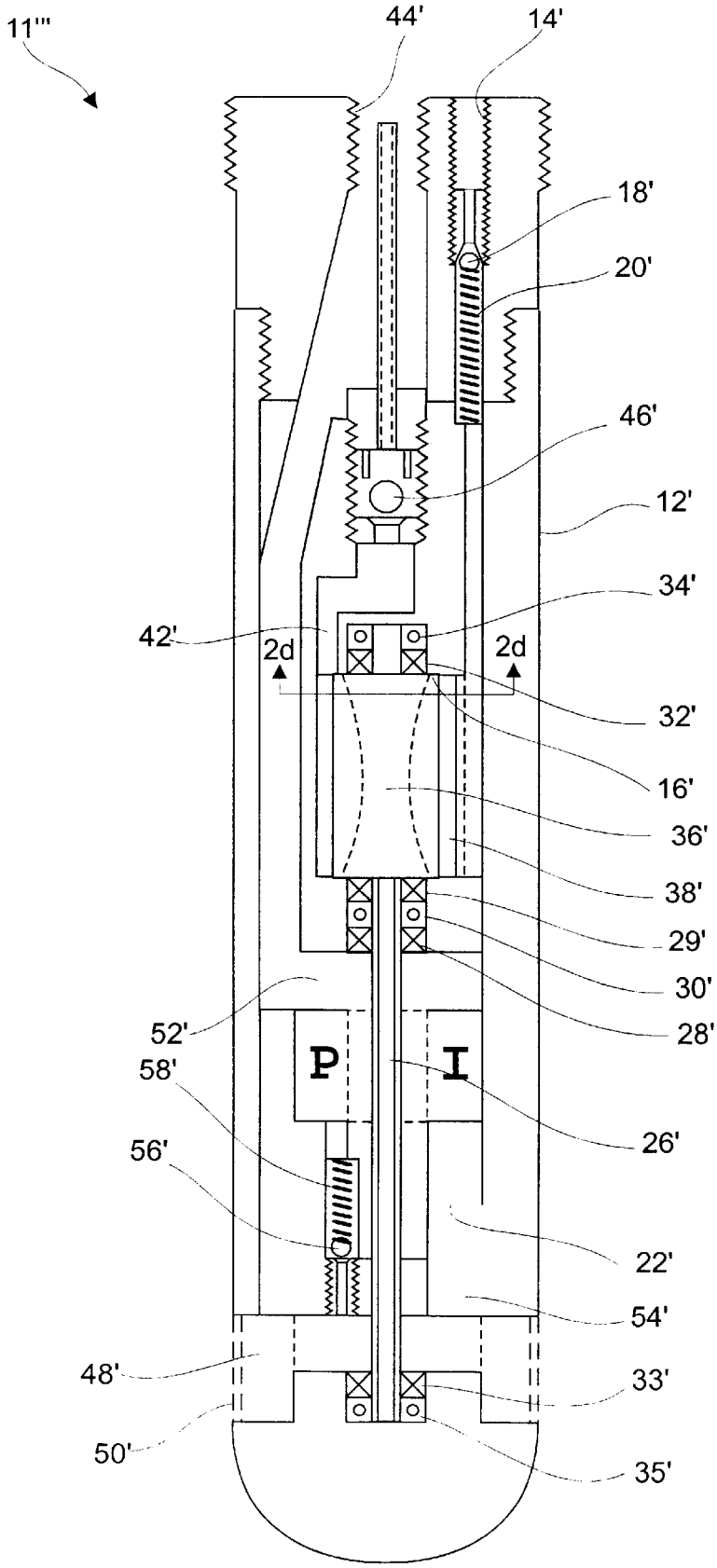
FIG. 2*c* is a cross-sectional view of an alternative part of the present invention.

FIGS. 2*b*–2*c* differ from FIG. 2*a* in the location of the ball-type check valve 56' and spring 58'. Notably, these elements are disposed between the second inlet 48' and second chamber 22' in FIG. 2*c*. FIG. 2*d* shows a cross section through FIG. 2*a*–2*a*.

The above described embodiment is set forth by way of example and is not for the purpose of limiting the present invention. It will be readily apparent to those skilled in the art that obvious modifications, derivations and variations can be made to the embodiment without departing from the scope of the invention. For example, the number of impellers and compressed air conduits leading to the impellers can be increased. However, it is believed by introducing the air adjacent one of the impellers which is positioned downstream, 16*a* for example, will enhance the drive of other impellers positioned more upstream therefrom. Accordingly, the claims appended hereto should be read in their full scope including any such modifications, derivations and variations.

What is claimed is:

1. A device for enhancing fluid flow in a well, which includes:

a housing;

a first inlet in said housing to receive a propellant;

wherein said propellant is a gas;

a third chamber within said housing communicating with said first inlet;

a first one way check valve disposed in said housing in a manner to permit communication from said first inlet to said first chamber;

means for biasing said first one way check valve closed until reaching a first predetermined pressure of said propellant;

a second chamber in said housing generally axially aligned with said first chamber;

a shaft bored surface interconnecting said first and said second chamber;

a shaft rotatably disposed within the shaft bored surface and extending from first chamber to said second chamber;

means for sealing about said shaft to prevent communication between said first chamber and said second chamber;

a rotor rotatably mounted within said first chamber and connected to said shaft in a manner to prevent rotational slippage with respect to said shaft;

a first exit channel within said housing connected to said first chamber;

an outlet in said housing communicating with said first exit channel;

a second one way check valve disposed in said housing in a manner to permit communication from said first exit channel to said outlet;

a second inlet in said housing communicating with said second chamber to permit receipt of fluid/gas stream fluids from the well therein;

a second exit channel within said housing interconnecting said second chamber with said outlet;

a pump impeller rotor rotatably mounted within said second chamber and connected to said shaft in a manner to prevent rotational slippage with respect to said shaft and in a manner to aid fluid flow from said second inlet to said second exit channel;

a third one way check valve disposed in said housing in a manner to permit communication from said second exit channel through to said outlet;

means for biasing said first one way check valve closed until reaching a first predetermined pressure of said fluid from said well;

a fluid/gas separator operably connected to said outlet in a manner to receive the fluid/gas stream and generally separate the fluid from the gas;

means positioned downstream of said outlet in a path of the fluid/gas stream for generating compressed gas, wherein said generating means generates the compressed gas using energy from the fluid/gas.

2. The device of claim 1, wherein said first inlet directs said propellant in a plane horizontal to an axis of rotation of said rotor.

3. The device of claim 1, wherein said first inlet resides in an upper portion of said housing and said second inlet resides in a lower portion of said housing and said outlet resides in an upper portion of said housing.

4. The device of claim 1, wherein said outlet is operably connected to a holding reservoir and said fluid gas is discharged into said holding reservoir.

5. The device of claim 1, wherein said second inlet includes a screen.

* * * * *